US009581949B2

(12) United States Patent
Komatsu et al.

(10) Patent No.: US 9,581,949 B2
(45) Date of Patent: Feb. 28, 2017

(54) FIXING DEVICE AND IMAGE FORMING APPARATUS

(71) Applicant: FUJI XEROX CO., LTD., Tokyo (JP)

(72) Inventors: Nobuyoshi Komatsu, Ebina (JP); Masaki Nagata, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/001,838

(22) Filed: Jan. 20, 2016

(65) Prior Publication Data

US 2017/0010573 A1 Jan. 12, 2017

(30) Foreign Application Priority Data

Jul. 7, 2015 (JP) ..... 2015-135948

(51) Int. Cl.
*G03G 15/20* (2006.01)

(52) U.S. Cl.
CPC ..... *G03G 15/2089* (2013.01); *G03G 15/2064* (2013.01)

(58) Field of Classification Search
CPC ..... G03G 15/2053; G03G 15/2064; G03G 15/2089
USPC ..... 399/329, 330
See application file for complete search history.

(56) References Cited

FOREIGN PATENT DOCUMENTS

| | | | |
|---|---|---|---|
| JP | 2001-356625 | A | 12/2001 |
| JP | 2008-225021 | A | 9/2008 |
| JP | 2014-228762 | A | 12/2014 |

*Primary Examiner* — Hoang Ngo
(74) *Attorney, Agent, or Firm* — Oliff PLC

(57) ABSTRACT

A fixing device includes a belt member that performs a circular motion by rotating in a predetermined belt rotation direction; a pressure-applying member that is pressed against an outer peripheral surface of the belt member and applies a pressure to a recording medium on which an image is formed; and a pressing member that extends in a belt width direction, which is a direction that crosses the belt rotation direction, inside the belt member and that is arranged so as to be deformed such that a central portion thereof in the belt width direction is convex toward an upstream side in the belt rotation direction, the pressing member pressing the pressure-applying member with the belt member interposed therebetween.

6 Claims, 6 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2015-135948 filed Jul. 7, 2015.

BACKGROUND

Technical Field

The present invention relates to a fixing device and an image forming apparatus.

SUMMARY

According to an aspect of the invention, there is provided a fixing device including a belt member that performs a circular motion by rotating in a predetermined belt rotation direction; a pressure-applying member that is pressed against an outer peripheral surface of the belt member and applies a pressure to a recording medium on which an image is formed; and a pressing member that extends in a belt width direction, which is a direction that crosses the belt rotation direction, inside the belt member and that is arranged so as to be deformed such that a central portion thereof in the belt width direction is convex toward an upstream side in the belt rotation direction, the pressing member pressing the pressure-applying member with the belt member interposed therebetween.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described in detail with reference to the accompanying drawings.

Figure 1:
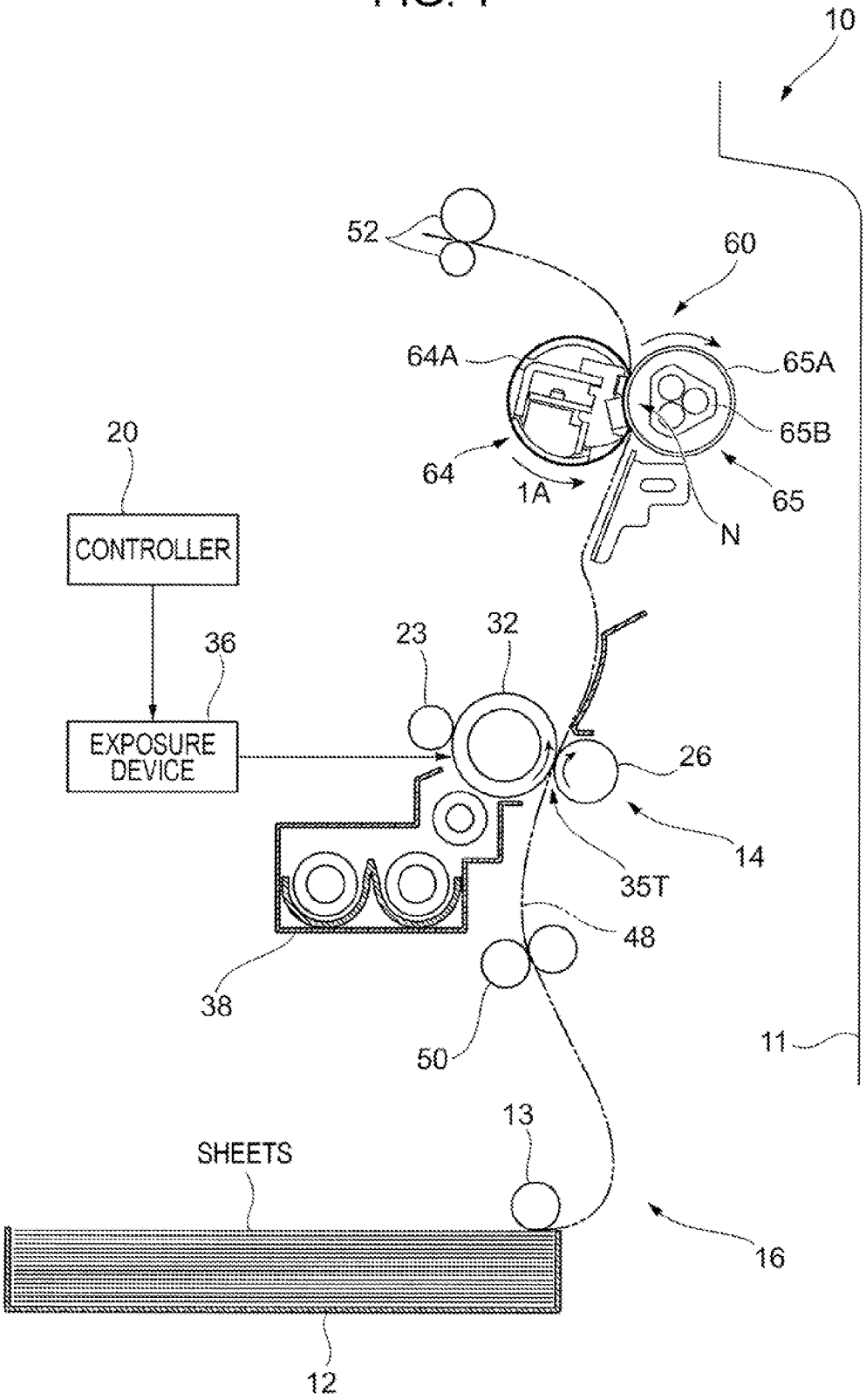
FIG. 1 illustrates the structure of an image forming apparatus according to an exemplary embodiment.

FIG. 1 illustrates the structure of an image forming apparatus 10 according to the exemplary embodiment.

The image forming apparatus 10 includes a housing 11. The housing 11 houses a container 12 that contains sheets, which are an example of recording media, and an image forming unit 14, which is an example of an image forming section that forms an image on each sheet.

The housing 11 further houses a sheet transport mechanism 16 that transports each sheet from the container 12 to the image forming unit 14 and a controller 20 that controls the operations of components of the image forming apparatus 10.

A sheet receiving portion (not shown) on which the sheet having the image formed thereon is stacked is disposed in an upper section of the housing 11.

The image forming unit 14 includes a photoconductor drum 32 that rotates counterclockwise in FIG. 1 and a transfer roller 26 that rotates clockwise in FIG. 1 and transfers a toner image carried by the photoconductor drum 32 onto the sheet.

A charging roller 23 that charges the photoconductor drum 32 is disposed around the photoconductor drum 32. An exposure device 36, which forms an electrostatic latent image on the photoconductor drum 32 by irradiating the photoconductor drum 32 with light based on image data obtained from the controller 20, is also disposed around the photoconductor drum 32.

A developing device 38, which forms a toner image on the photoconductor drum 32 by developing the electrostatic latent image formed by the exposure device 36, is also disposed around the photoconductor drum 32.

The sheet transport mechanism 16 includes a sheet transport path 48, which is a path along which the sheet is transported. The sheet transport mechanism 16 also includes transport rollers 50 that are provided on the sheet transport path 48 to transport the sheets. Although only one pair of transport rollers 50 are shown in FIG. 1, plural pairs of transport rollers 50 are provided in practice.

A fixing device 60, which transfers the toner image that has been transferred onto the sheet to the sheet, is disposed above a transfer region 35T formed between the photoconductor drum 32 and the transfer roller 26, that is, at a location downstream of the transfer region 35T in a transporting direction of the sheet. Transport rollers 52 that transport the sheet to which the toner image is fixed to the sheet receiving portion (not shown) is disposed above the fixing device 60 in FIG. 1.

In the image forming apparatus 10 according to the present exemplary embodiment, first, a feed roller 13 feeds the top sheet of the stack of sheets contained in the container 12 to the sheet transport path 48. Then, the transport rollers 50 provided on the sheet transport path 48 transport the sheet to the transfer region 35T.

In the image forming unit 14, the photoconductor drum 32 is charged by the charging roller 23, and then irradiated with light by the exposure device 36, so that the electrostatic latent image is formed on the photoconductor drum 32. Then, the electrostatic latent image is developed by the developing device 38, so that the toner image is formed on the photoconductor drum 32.

The toner image is transferred onto the sheet by the transfer roller 26 in the transfer region 35T. Then, the sheet is transferred to the fixing device 60, and the fixing device 60 performs a heating process and a pressure-applying process on the sheet. The sheet that has passed through the fixing device 60 is stacked on the sheet receiving portion (not shown).

The structure of the fixing device 60 will now be described.

As illustrated in FIG. 1, the fixing device 60 according to the present exemplary embodiment includes a fixing belt module 64 that is used to fix the toner image to the sheet.

The fixing belt module 64 includes a belt member 64A that performs a circular motion by rotating in the direction of arrow 1A in FIG. 1.

The fixing device 60 also includes a pressure-applying roller 65, which is an example of a pressure-applying member.

The pressure-applying roller 65 is pressed against the outer peripheral surface of the belt member 64A included in the fixing belt module 64, so that a pressure is applied to the sheet on which the image is formed.

The pressure-applying roller 65 includes a cylindrical member 65A formed of a metal material, such as aluminum. A heat source 65B, such as a halogen lamp, is disposed in the cylindrical member 65A.

Figure 2:
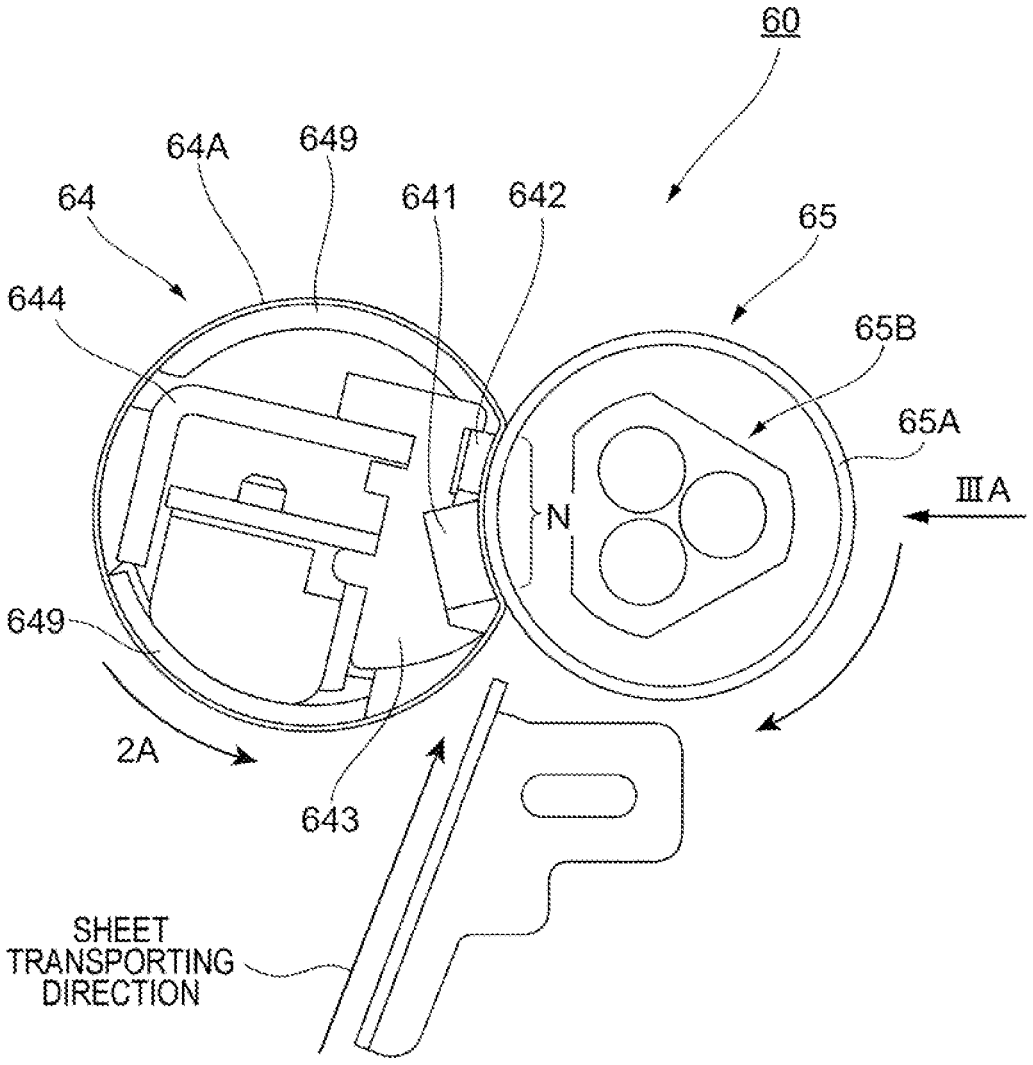
FIG. 2 is an enlarged view of a fixing device.

In FIGS. 1 and 2, the pressure-applying roller 65 comes into contact with the back side of the sheet, and the fixing belt module 64 comes into contact with the front side (image side) of the sheet. Alternatively, however, the pressure-applying roller 65 may come into contact with the front side (image) of the sheet, and the fixing belt module 64 may come into contact with the back side of the sheet.

In the present exemplary embodiment, the sheet is supplied to a nip portion N, which is a portion in which the fixing belt module 64 and the pressure-applying roller 65 are in contact with each other. The sheet is pressed between the fixing belt module 64 and the pressure-applying roller 65 in the nip portion N. Thus, the toner image on the sheet is pressed and heated, and is thereby fixed to the sheet.

In the present exemplary embodiment, the pressure-applying roller 65 is rotated by a motor (not shown), and the belt member 64A included in the fixing belt module 64 is rotated by the rotation of the pressure-applying roller 65.

In the pressure-applying roller 65 according to the present exemplary embodiment, the cylindrical member 65A is not provided with an elastic layer having a certain thickness at the periphery thereof. Therefore, the temperature at the contact portion (nip portion N) between the fixing belt module 64 and the pressure-applying roller 65 increases more rapidly than in the case where the elastic layer is provided.

In the present exemplary embodiment, the fixing belt module 64 is provided with pad-shaped members, which will be described in detail below. The pad-shaped members are pressed against the pressure-applying roller 65 so that heat and pressure are more easily transmitted to the sheet that passes through the nip portion N.

FIG. 2 is an enlarged view of the fixing device 60.

As described above, the fixing device 60 includes the fixing belt module 64 and the pressure-applying roller 65 that is pressed against the fixing belt module 64.

An upstream pressing member 641 and a downstream pressing member 642, which are formed of pad-shaped members, are disposed inside the belt member 64A of the fixing belt module 64.

The upstream pressing member 641 and the downstream pressing member 642, which are disposed inside the belt member 64A, press the pressure-applying roller 65 with the belt member 64A interposed between each of the upstream and downstream pressing members 641 and 642 and the pressure-applying roller 65.

The upstream pressing member 641 is at an upstream position in the rotation direction of the belt member 64A (direction of arrow 2A in FIG. 2), and the downstream pressing member 642 is at a downstream position in the rotation direction of the belt member 64A. In the present exemplary embodiment, since two pressing members, which are the upstream pressing member 641 and the downstream pressing member 642, are provided, the region in which the sheet is pressed is increased, that is, the length of the nip portion N in the rotation direction of the belt member 64A is increased.

The upstream pressing member 641 and the downstream pressing member 642 are formed of silicone. The downstream pressing member 642 has a hardness higher than that of the upstream pressing member 641.

In the present exemplary embodiment, a pad support member 643 that supports the upstream pressing member 641 and the downstream pressing member 642 and a support frame 644 that supports the pad support member 643 are disposed inside the belt member 64A. A guide member 649, which guides the belt member 64A, is also disposed inside the belt member 64A.

Figure 3A:
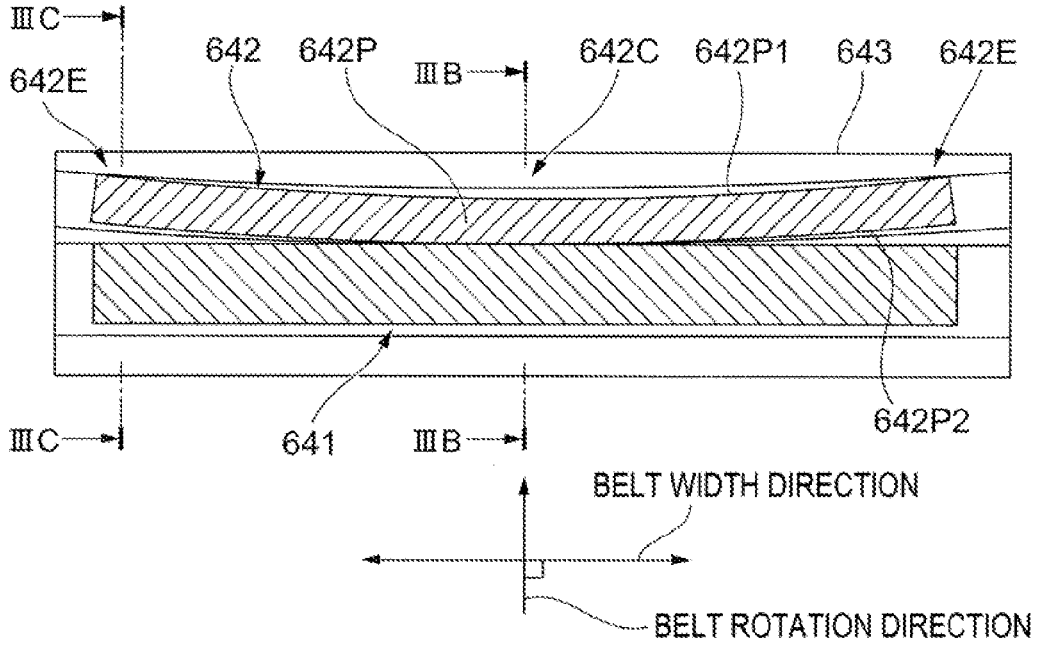
FIGS. 3A, 3B, and 3C illustrate an upstream pressing member and a downstream pressing member.
Figure 3B:
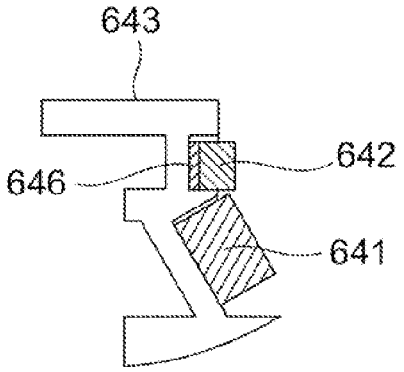
Figure 3C:
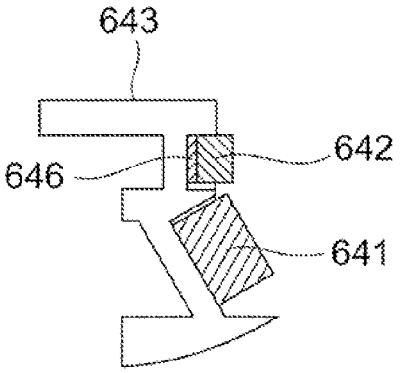

FIGS. 3A, 3B, and 3C illustrate the upstream pressing member 641 and the downstream pressing member 642. FIG. 3A illustrates the upstream pressing member 641, the downstream pressing member 642, and the pad support member 643 viewed in the direction of arrow IIIA in FIG. 2. FIG. 3B is a sectional view taken along line IIIB-IIIB in FIG. 3A, and FIG. 3C is a sectional view taken along line IIIC-IIIC in FIG. 3A.

As illustrated in FIG. 3A, the upstream pressing member 641 and the downstream pressing member 642 extend in the width direction of the belt member 64A, which is not illustrated in FIGS. 3A to 3C (hereinafter referred to as a "belt width direction"). More specifically, the upstream pressing member 641 and the downstream pressing member 642 extend in the belt width direction, which is a direction that crosses (that is perpendicular to) the rotation direction of the belt member 64A (hereinafter referred to as a "belt rotation direction").

As illustrated in FIG. 3A, the downstream pressing member 642 is deformed (curved) such that a central portion 642C thereof in the belt width direction is convex toward the upstream side in the belt rotation direction.

More specifically, the downstream pressing member 642 is deformed such that both end portions 642E thereof in the belt width direction are located downstream of the central portion 642C in the belt rotation direction.

The downstream pressing member 642 has a rectangular-parallelepiped shape in a free state. In the present exemplary embodiment, the downstream pressing member 642 is deformed such that the central portion 642C is convex toward the upstream side in the belt rotation direction. Then, the downstream pressing member 642 is attached to the pad support member 643 in the deformed state.

More specifically, in the present exemplary embodiment, as illustrated in FIGS. 3B and 3C, a metal plate 646 to which the downstream pressing member 642 is attached is provided. In the present exemplary embodiment, the downstream pressing member 642 is attached to the metal plate 646, and then the metal plate 646 is deformed so that the downstream pressing member 642 is deformed accordingly.

The downstream pressing member 642 is deformed by, for example, plastically deforming the metal plate 646.

Alternatively, for example, a recess that receives the metal plate 646 in a curved state may be formed in the pad support member 643 at a location where the metal plate 646 is to be mounted, and the downstream pressing member 642 may be deformed by fitting the metal plate 646 to the recess.

Alternatively, for example, plural projections may be formed on the pad support member 643 at a location where the metal plate 646 is to be mounted, and the downstream pressing member 642 may be deformed by fitting the metal plate 646 in a curved state to a region surrounded by the projections.

When the downstream pressing member 642 in the deformed state is provided as in the present exemplary embodiment, the occurrence of wrinkles in the sheet may be reduced.

Figure 4:
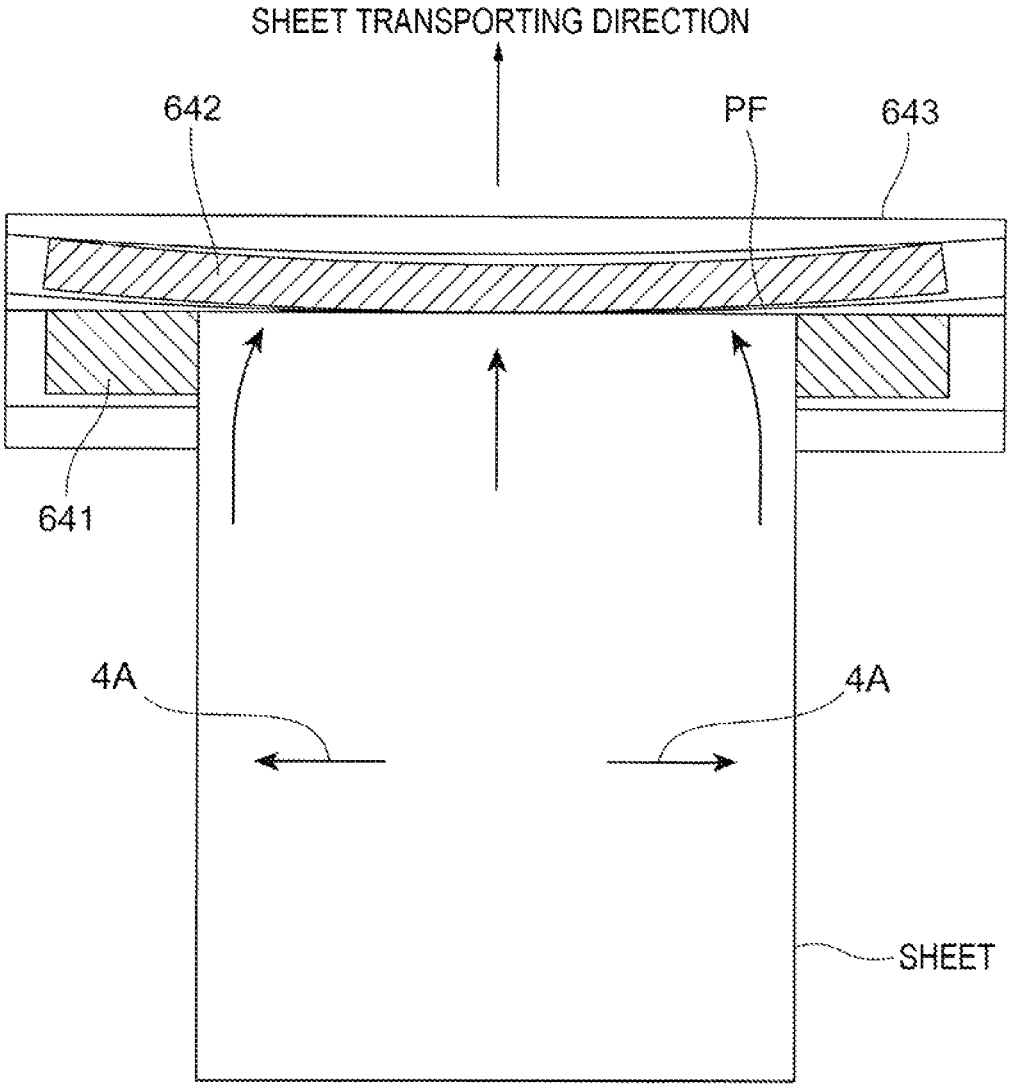
FIG. 4 illustrates the movement of a sheet when the sheet passes the downstream pressing member.

FIG. 4 illustrates the movement of the sheet when the sheet passes the downstream pressing member 642.

As illustrated in FIG. 4, when the leading end PF of the sheet approaches the downstream pressing member 642, first, the central portion of the leading end PF in the longitudinal direction of the leading end PF reaches the downstream pressing member 642, so that the moving speed of the central portion temporarily decreases. At this time, the moving speed of both end portions of the leading end PF in the longitudinal direction of the leading end PF is higher than that of the central portion.

As a result, as shown by the arrows 4A in FIG. 4, the sheet receives a tension that pulls the sheet in the width direction, so that the occurrence of wrinkles in the sheet is reduced.

In addition, in the structure of the present exemplary embodiment, a downstream portion of the downstream pressing member 642 in the belt rotation direction is compressed by a greater amount than an upstream portion of the downstream pressing member 642 in the belt rotation direction, and the hardness of the downstream portion is higher than that of the upstream portion.

As illustrated in FIG. 3A, the downstream pressing member 642 includes a pressing surface 642P that presses the pressure-applying roller 65 with the belt member 64A interposed therebetween.

The pressing surface 642P includes a downstream side edge 642P1 and an upstream side edge 642P2. The downstream side edge 642P1 is located at the downstream side in the belt rotation direction and extends in the belt width direction. The upstream side edge 642P2 is located at the upstream side in the belt rotation direction and extends in the belt width direction.

In the present exemplary embodiment, the downstream pressing member 642 is deformed so as to be convex toward the upstream side in the belt rotation direction. Therefore, a portion of the downstream pressing member 642 that extends along the downstream side edge 642P1 (hereinafter referred to as a "downstream side portion") is compressed by a greater amount than a portion of the downstream pressing member 642 that extends along the upstream side edge 642P2 (hereinafter referred to as an "upstream side portion").

In this case, the downstream side portion has a density higher than that of the upstream side portion, and also has a hardness higher than that of the upstream side portion.

Accordingly, in the present exemplary embodiment, a simple structure in which the nip pressure is increased at the downstream side is provided.

In general, in the nip portion N, the nip pressure at the upstream side in the belt rotation direction is set so as to be smaller than that at the downstream side in the belt rotation direction downstream, and melting of the toner image on the sheet is accelerated at the upstream side in the belt rotation direction. The nip pressure is increased at the downstream side in the belt rotation direction, so that the toner image in the molten state is pressed against the sheet in the region in which the nip pressure is high.

In the structure of the present exemplary embodiment, the nip pressure may be increased at the downstream side in the belt rotation direction simply by deforming the downstream pressing member 642 such that the downstream pressing member 642 is convex toward the upstream side in the belt rotation direction. More specifically, as described above, the downstream pressing member 642 is formed such that the downstream side portion, which is at the downstream side in the belt rotation direction, has a high hardness so that the nip pressure at the downstream side in the belt rotation direction is increased.

The nip pressure at the downstream side in the belt rotation direction may also be increased by, for example, forming the downstream pressing member 642 such that it includes two components and pressing one of the components that is disposed at the downstream side more strongly against the pressure-applying roller 65 than the other component that is disposed at the upstream side. However, in this case, the number of components is increased and the apparatus tends to have a complex structure.

In contrast, according to the present exemplary embodiment, the nip pressure at the downstream side in the belt rotation direction may be increased with a single downstream pressing member 642 without using two components.

FIGS. 5A, 5B, 5C, and 6 illustrates examples of other arrangements of the downstream pressing member 642.

Figure 5A:
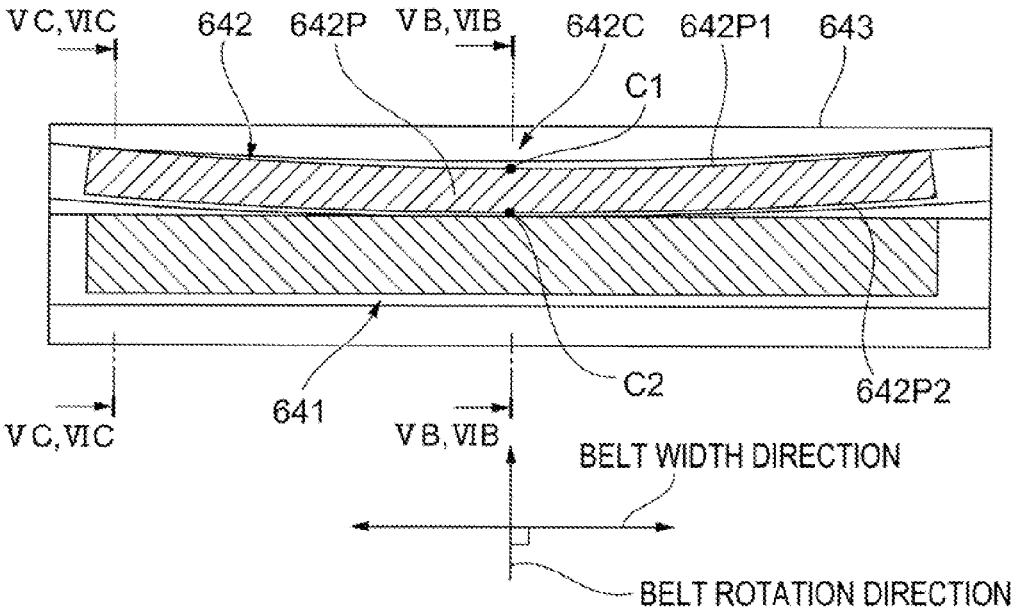
FIGS. 5A, 5B, and 5C illustrate another arrangement of the downstream pressing member.
Figure 5B:
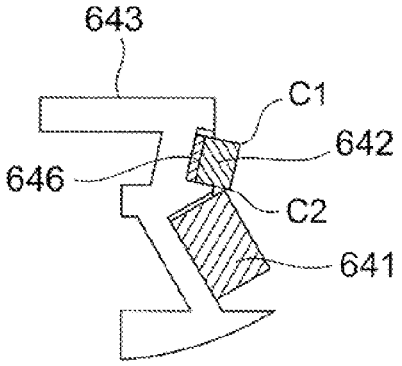
Figure 5C:
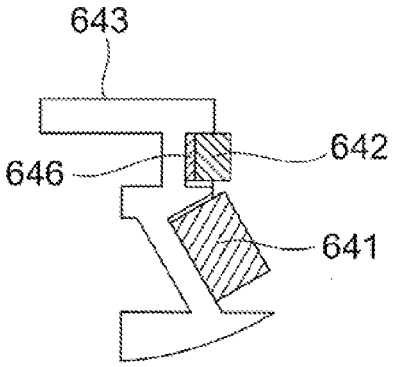

FIG. 5A is a front view of the downstream pressing member 642 and other components, FIG. 5B is a sectional view taken along line VB-VB in FIG. 5A, and FIG. 5C is a sectional view taken along line VC-VC in FIG. 5A.

Figure 6:
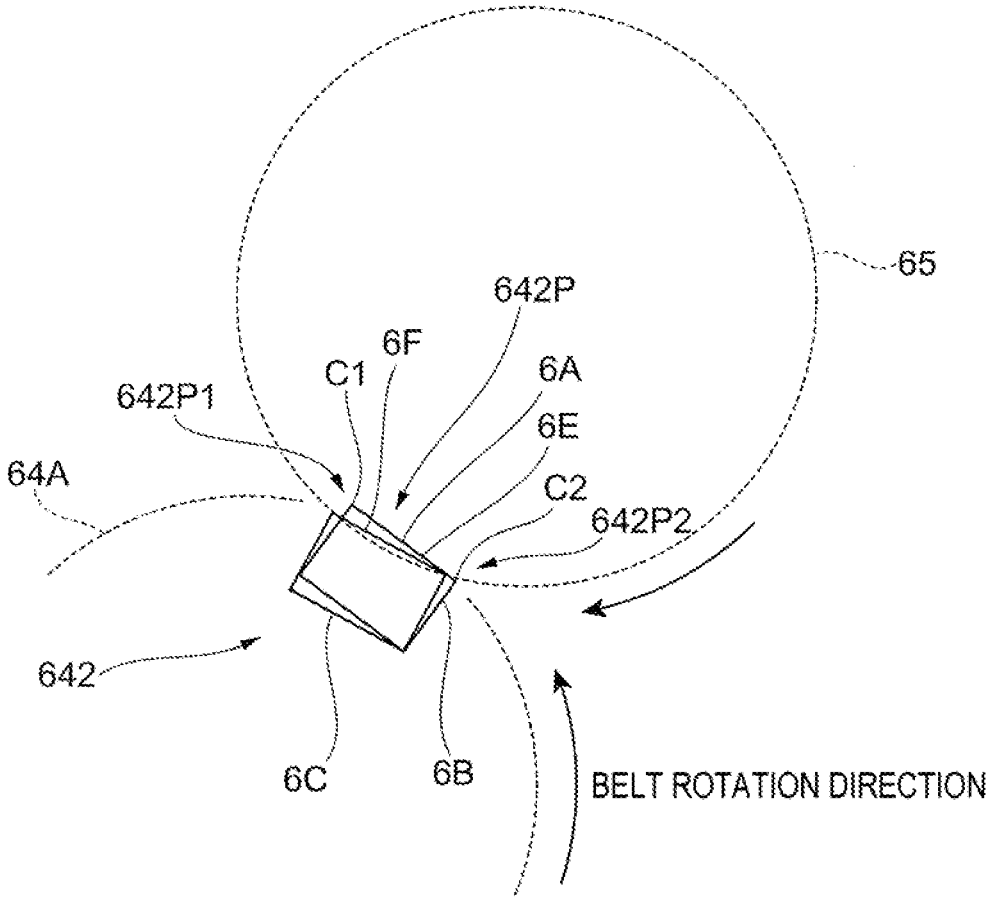
FIG. 6 illustrates another arrangement of the downstream pressing member.

FIG. 6 is a sectional view of the downstream pressing member 642. In FIG. 6, the pressure-applying roller 65 is also illustrated. The cross section denoted by 6B in FIG. 6 is taken along line VIB-VIB in FIG. 5A, and the cross section denoted by 6C in FIG. 6 is taken along line VIC-VIC in FIG. 5A.

FIGS. 5A to 5C and FIG. 6 illustrate the downstream pressing member 642 in the state in which the downstream pressing member 642 is separated from the pressure-applying roller 65 and the belt member 64A.

In this structure, as described above, and as illustrated in FIG. 5A, the downstream pressing member 642 is deformed such that the central portion 642C thereof in the belt width direction is convex toward the upstream side in the belt rotation direction.

In addition, in this structure, as illustrated in FIGS. 5A, 5B, and 6, the central portion C1 of the downstream side edge 642P1 in the belt width direction projects toward the pressure-applying roller 65 side (see FIG. 6), and the central portion C1 is located further toward the pressure-applying roller 65 side than the central portion C2 of the upstream side edge 642P2 in the belt width direction is.

Similar to the above-described case, the central portion C1 is arranged so as to project in the above-described manner by deforming the metal plate 646 to which the downstream pressing member 642 is attached.

In the present exemplary embodiment, as shown by reference numeral 6A in FIG. 6, the pressing surface 642P of the downstream pressing member 642 is inclined so as to extend toward the downstream side in the rotation direction of the belt member 64A (belt rotation direction) and toward the pressure-applying roller 65 side. More specifically, a portion of the pressing surface 642P at a central region in the belt width direction extends toward the downstream side in the belt rotation direction and toward the pressure-applying roller 65 side.

Accordingly, in the present exemplary embodiment, wrinkles formed when the sheet passes through the nip portion N are further reduced.

In the case where the central portion C1 of the downstream side edge 642P1 projects toward the pressure-applying roller 65 side, the reaction force applied to the central portion of the sheet in the width direction by the downstream pressing member 642 is greater than that in the case where the central portion C1 does not project.

As a result, the difference between the movement speed of the central portion of the sheet in the width direction and that movement speed of both end portions of the sheet in the width direction increases, and the tension applied to the sheet increases accordingly.

In addition, in the present exemplary embodiment, the central portion of the pressing surface 642P in the belt width direction (portion denoted by 6E in FIG. 6) is located further toward the pressure-applying roller 65 side than each end portion of the pressing surface 642P in the belt width direction (portion denoted by 6F in FIG. 6) is. This leads to an improvement of the quality of the fixed image.

In the above-described exemplary embodiment, when the downstream pressing member 642 is pressed against the pressure-applying roller 65, the central portion of the pressure-applying roller 65 in the axial direction moves away from the downstream pressing member 642. Accordingly, the contact pressure between the pressure-applying roller 65 and the downstream pressing member 642 decreases in the central region.

In such a case, it becomes difficult to apply a sufficient pressure to the toner image in the central region, and the quality of the fixed image easily decreases.

In contrast, in the present exemplary embodiment, as described above, the central portion of the pressing surface 642P in the belt width direction is located further toward the pressure-applying roller 65 side than both end portions of the pressing surface 642P in the belt width direction are. Accordingly, in the present exemplary embodiment, the reduction in the contact pressure in the central region of the pressure-applying roller 65 in the axial direction is suppressed, so that the quality of the fixed image is not easily reduced.

Also in the structure illustrated in FIG. 3, the central portion of the pressing surface 642P in the belt width direction may be located further toward the pressure-applying roller 65 side than both end portions in the belt width direction are. Also in this case, reduction in the contact pressure in the central region of the pressure-applying roller 65 in the axial direction is suppressed, and the quality of the fixed image is not easily reduced.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member that performs a circular motion by rotating in a predetermined belt rotation direction;

a pressure-applying member that is pressed against an outer peripheral surface of the belt member and applies a pressure to a recording medium on which an image is formed; and a pressing member that extends in a belt width direction, which is a direction that crosses the belt rotation direction, inside the belt member and that is arranged so as to be deformed such that a central portion thereof in the belt width direction is convex toward an upstream side in the belt rotation direction, the pressing member pressing the pressure-applying member with the belt member interposed therebetween.

2. The fixing device according to claim 1, wherein the pressing member has a pressing surface that presses the pressure-applying member with the belt member interposed therebetween, wherein the pressing surface has a downstream side edge that extends in the belt width direction at a downstream side in the belt rotation direction and an upstream side edge that extends in the belt width direction at an upstream side in the belt rotation direction, and wherein a portion of the pressing member along the downstream side edge is compressed by a greater amount than a portion of the pressing member along the upstream side edge as a result of the deformation of the pressing member.

3. The fixing device according to claim 2, wherein, in the state in which the pressing member is separated from the pressure-applying member and the belt member, a central portion of the pressing surface in the belt width direction is located further toward a pressure-applying-member side than both end portions of the pressing surface in the belt width direction are.

4. The fixing device according to claim 1, wherein the pressing member has a pressing surface that presses the pressure-applying member with the belt member interposed therebetween, wherein the pressing surface has a downstream side edge that extends in the belt width direction at a downstream side in the belt rotation direction and an upstream side edge that extends in the belt width direction at an upstream side in the belt rotation direction, and wherein, in a state in which the pressing member is separated from the pressure-applying member and the belt member, a central portion of the downstream side edge in the belt width direction is located further toward a pressure-applying-member side than a central portion of the upstream side edge in the belt width direction is.

5. The fixing device according to claim 4, wherein, in the state in which the pressing member is separated from the pressure-applying member and the belt member, a central portion of the pressing surface in the belt width direction is located further toward a pressure-applying-member side than both end portions of the pressing surface in the belt width direction are.

6. An image forming apparatus comprising:

an image forming section that forms an image on a recording medium;

a belt member that performs a circular motion by rotating in a predetermined belt rotation direction;

a pressure-applying member that is pressed against an outer peripheral surface of the belt member and applies a pressure to the recording medium on which the image is formed by the image forming section; and a pressing member that extends in a belt width direction, which is a direction that crosses the belt rotation direction, inside the belt member and that is arranged so as to be deformed such that a central portion thereof in the belt width direction is convex toward an upstream side in the belt rotation direction, the pressing member pressing the pressure-applying member with the belt member interposed therebetween.

* * * * *